US008528333B2

(12) United States Patent
Juchymenko

(10) Patent No.: US 8,528,333 B2
(45) Date of Patent: Sep. 10, 2013

(54) CONTROLLED ORGANIC RANKINE CYCLE SYSTEM FOR RECOVERY AND CONVERSION OF THERMAL ENERGY

(76) Inventor: Victor Juchymenko, Calgary (CA)

( * ) Notice: Subject to any disclaimer, the term of this patent is extended or adjusted under 35 U.S.C. 154(b) by 954 days.

(21) Appl. No.: 12/529,539

(22) PCT Filed: Mar. 3, 2008

(86) PCT No.: PCT/CA2008/000402

§ 371 (c)(1),
(2), (4) Date: Sep. 1, 2009

(87) PCT Pub. No.: WO2008/106774

PCT Pub. Date: Sep. 12, 2008

(65) Prior Publication Data

US 2010/0018207 A1 Jan. 28, 2010

Related U.S. Application Data

(60) Provisional application No. 60/892,837, filed on Mar. 2, 2007.

(51) Int. Cl.
*F01K 23/10* (2006.01)
*F01K 25/00* (2006.01)

(52) U.S. Cl.
USPC ..... 60/618; 60/651; 60/664; 60/666; 60/668; 60/671; 60/676

(58) Field of Classification Search
USPC ..... 60/614, 616, 618, 651, 671, 660, 60/664, 666, 668, 676
See application file for complete search history.

(56) References Cited

U.S. PATENT DOCUMENTS

| | | | | |
|---|---|---|---|---|
| 3,948,053 | A * | 4/1976 | Gamell | 60/618 |
| 4,228,657 | A | 10/1980 | Leo | |
| 4,235,077 | A * | 11/1980 | Bryant | 60/618 |
| 4,271,664 | A | 6/1981 | Earnest | |
| 4,300,353 | A * | 11/1981 | Ridgway | 60/618 |
| 4,557,112 | A * | 12/1985 | Smith | 60/651 |
| 4,754,912 | A * | 7/1988 | Burns | 228/164 |
| 4,901,531 | A | 2/1990 | Kubo et al. | |
| 5,000,003 | A | 3/1991 | Wicks | |
| 5,440,882 | A | 8/1995 | Kalina | |
| 6,986,251 | B2 | 1/2006 | Radcliff et al. | |
| 7,296,562 | B2 * | 11/2007 | Withrow et al. | 123/559.1 |

FOREIGN PATENT DOCUMENTS

| | | |
|---|---|---|
| CA | 2425433 A1 | 4/2003 |
| CA | 2505600 | 5/2004 |
| EP | 0015208 A1 | 9/1980 |
| FR | 2885169 A1 | 11/2006 |
| WO | WO/2006/138459 | 12/2006 |

* cited by examiner

*Primary Examiner* — Hoang Nguyen
(74) *Attorney, Agent, or Firm* — William J. Bundren

(57) ABSTRACT

A system for controlled recovery of thermal energy and conversion to mechanical energy. The system collects thermal energy from a reciprocating engine, specifically from engine jacket fluid and/or engine exhaust and uses this thermal energy to generate a secondary power source by evaporating an organic propellant and using the gaseous propellant to drive an expander in production of mechanical energy. A monitoring module senses ambient and system conditions such as temperature, pressure, and flow of organic propellant at one or more locations; and a control module regulates system parameters based on monitored information to optimize secondary power output. A tertiary, or back-up power source may also be present. The system may be used to meet on-site power demands using primary, secondary, and tertiary power.

34 Claims, 9 Drawing Sheets

CONTROLLED ORGANIC RANKINE CYCLE SYSTEM FOR RECOVERY AND CONVERSION OF THERMAL ENERGY

FIELD OF THE INVENTION

The present invention relates generally to thermal energy recovery systems. More particularly, the present invention relates to a system for recovering thermal energy from a reciprocating engine and converting the thermal energy to secondary power through controlled operation of an organic Rankine cycle system.

BACKGROUND OF THE INVENTION

Methods for implementing a Rankine cycle within a system to recover thermal energy from an engine are well known. Although these systems were initially developed to produce steam that could be used to drive a steam turbine, the basic principles of the Rankine cycle have since been extended to lower temperature applications by the use of volatile organic chemicals as propellants with the system. Such organic Rankine cycles (ORCs) are typically used within thermal energy recovery systems or geothermal applications, in which heat is converted into secondary mechanical energy that can be used to generate electrical energy. As such, these systems have become particularly useful in heat recovery and power generation—collecting heat from turbine exhaust gas, combustion processes, geothermal sources, solar heat collectors, and thermal energy from other industrial sources. Organic Rankine cycles are generally most useful within temperature ranges from 158 to 752 degrees F., and are most often used to produce power between 400 kW and 5000 kW of power.

Generally, a Rankine-based heat recovery system includes a propellant pump for driving propellant through the system, an evaporator for evaporating propellant that has become heated by collection of waste heat, a turbine through which evaporated propellant is expanded to create power or perform work, and a condenser for cooling the propellant back to liquid state so it may be pumped to collect heat again and repeat the cycle. The basic Rankine cycle has been adapted for collection of heat from various sources, with conversion of the heat energy to other energy outputs.

For example, U.S. Pat. No. 5,440,882 describes a method for using geothermal energy to drive a modified ORC based system that uses an ammonia and water mixture as the propellant. The evaporated working fluid is used to operate a second turbine, generating additional power. Heat is conserved within the Rankine cycle portion of the system through the use of a recuperator heat exchanger at the working fluid condensation stage.

U.S. Pat. No. 6,986,251 describes a Rankine cycle system for extracting waste heat from several sources in a reciprocating engine system. A primary propellant pump drives the Rankine cycle with assistance from the auxiliary booster pump, to limit pump speeds and avoid cavitation. When the Rankine cycle is inactive (e.g. due to reciprocating engine failure or maintenance), the auxiliary pump operates alone, circulating propellant until the propellant and system components have cooled sufficiently for complete shut down. Diversions are present to prevent circulation of propellant through the evaporator and through the turbine during this cooling cycle.

U.S. Pat. No. 4,228,657 describes the use of a screw expander within a Rankine cycle system. The screw expander is used to expand a thermodynamic fluid, and waste heat is further extracted from the expander in order to improve system efficiency. A geothermal well supplies pressurized hot water or brine as the heat source.

When using organic propellants within a Rankine cycle, care must be taken to avoid exposure of the propellants to flame. Although specialized organic propellants having high flash temperatures (for example Genetron® R-245fa, which is 1,1,1,3,3-pentafluoropropane) have been developed, the danger of combustibility still exists, as engine exhaust may reach temperatures up to 1200 degrees F. A leak in an exhaust heat exchanger could therefore be disastrous. Further, the purchase of proprietary propellants adds a significant start-up cost to these systems.

A common problem particularly relevant to recovery of thermal energy is that when using air-cooled condensers, ambient air temperatures significantly impact the system efficiency and total power available.

SUMMARY OF THE INVENTION

It is an object of the present invention to obviate or mitigate at least one disadvantage of previous Rankine-based heat recovery systems.

In a first aspect of the invention, there is provided a system for controlled recovery of thermal energy from a reciprocating engine and conversion of said thermal energy to mechanical energy, the system comprising: a reciprocating engine operable to provide a primary power source; a circulating pump, at least one heat exchanger, an expander, and a condenser, arranged to operate an organic Rankine cycle in which thermal energy is collected from the engine and is transferred to a liquid organic propellant in the propellant heat exchanger to evaporate the propellant, which gaseous propellant then drives the expander in production of mechanical energy to create a secondary power source, with propellant from the expander condensed back into liquid form by the condenser for reuse within the organic Rankine cycle; a monitoring module for sensing system operating conditions including at least one of: temperature; pressure; and flow of organic propellant, at one or more locations within the Rankine cycle; and a control module for acquiring and processing information received from the monitoring module, and for regulating operation of the system based on said information to optimize power generation of the secondary power source. The secondary power source may be operatively connected to the engine to provide supplementary power, for example by powering some or all of the parasitic loads of the primary power source or by providing power to the facility in which the primary power source is located. The supplementary/secondary power may be provided as mechanical shaft horsepower or electric power.

In an embodiment of this aspect of the invention, thermal energy is collected from the reciprocating engine by circulation of fluid about the engine jacket, which thermal energy is then transferred from the jacket fluid to the organic propellant at the heat exchanger. In this embodiment, the control module may regulate the flow of jacket fluid between the engine and the heat exchanger to control the amount of thermal energy collected from the engine for use within the Rankine cycle. A jacket fluid diverter valve may be provided to control direction of engine jacket fluid to either the jacket fluid heat exchanger or to the engine radiator. The control module may regulate operation of this valve to control the amount of flow, and thus thermal energy, transferred to the organic propellant.

Additional thermal energy may also be collected from the reciprocating engine exhaust by circulation of thermal fluid about a thermal fluid heat exchanger within the reciprocating engine exhaust system, with said additional thermal energy transferred to the organic propellant at a second propellant heat exchanger. The thermal fluid is any suitable fluid, for example, one comprising water, glycol, mineral-based thermal oil, or synthetic-based thermal oil. An exhaust diverter valve may be present and may be regulated by the control system to control the amount of thermal energy transferred to the organic propellant.

In a second embodiment, thermal energy is collected from the reciprocating engine by circulation of thermal fluid about a thermal fluid heat exchanger within the engine exhaust system, which thermal energy is then transferred from the thermal fluid to the organic propellant at the propellant heat exchanger. The thermal fluid may be any suitable fluid such as a mineral based oil or a synthetic thermal oil.

In certain embodiments, the jacket fluid may be water, glycol, or a combination of water and glycol. Suitable thermal fluids may be water, glycol, or a combination of water and glycol, mineral based thermal oils or synthetic thermal oils.

In this embodiment, the control module may further include an exhaust diverter valve for venting exhaust gas to atmosphere. The control module regulates operation of the diverter valve and may further regulate thermal fluid flow to control the amount of thermal energy transferred to the thermal fluid for subsequent exchange with organic propellant at the propellant heat exchanger.

In another embodiment, the monitoring module comprises a sensor at the expander and/or at the condenser, which may be a temperature sensor or a pressure sensor. The monitoring module may further include an ambient air temperature sensor. The monitoring and control module may co-exist in a single unit.

In a suitable embodiment, the control module includes a processor for processing data received from the monitoring module to determine the physical state of the propellant and the ambient air temperature at monitored locations within the system. Comparisons may be made to previously simulated performance data in order to determine appropriate adjustments to the system. The control module may adjust one of: the rate of heat transfer from the engine to the propellant; the rate of heat removed by the condenser; the flow rate of organic propellant; and propellant pressure within the system in response to said data processing.

In an embodiment, a motor control centre receives electric power and supplies same to the ORC system and connected site loads, on demand. The motor control centre may receive power from the primary, secondary, and tertiary power sources.

The monitoring module may further monitor on-site power demand, with the control module responding to the monitored power demand to allocate power to system components accordingly.

In certain embodiments, the condenser is air cooled and includes a fan for cooling propellant at the condenser, and the control module may adjust the speed of the fan based on monitored operating conditions. The fan may be located proximal to a jacket fluid radiator such that the fan simultaneously blows air across the radiator and the condenser.

In other embodiments, the condenser is liquid cooled and includes cooling fluid for circulation about propellant conduits by a circulating pump, and the control module may adjust the rate of circulation of cooling water about the propellant conduits based on monitored operating conditions. The engine radiator may be located proximal to the organic propellant condenser such that the circulating pump simultaneously cools engine jacket fluid within the radiator and propellant within the condenser.

In an embodiment, the reciprocating engine powers a natural gas compression module. A boost compressor may further be present, powered by secondary power generated by the expander, for example by mechanical shaft horsepower from the expander, or by electric power generated by the expander.

The natural gas compression module may comprise a cooling module to remove heat from the natural gas after each stage of gas compression. The cooling module may include a fan controlled by the control module based on ambient air temperatures, natural gas temperatures (after being compressed), flow rate of natural gas, and radiator fluid temperatures (when the radiator is co-located with the gas coolers, sharing the same fan).

The fan may receive tertiary electric power; secondary power, which may be provided as mechanical shaft horsepower; or electrical power or primary power, which may be provided as mechanical shaft horsepower or electrical power.

In certain embodiments, thermal energy generated during compression of natural gas may be transferred to the organic propellant for use within the organic Rankine cycle.

In suitable embodiments, an electric fan may be used to cool one or more of: organic propellant within the condenser conduits; radiator fluid within the engine radiator; and natural gas within the natural gas conduits. Any two or more of these components may be co-located to permit cooling by one electric fan regulated by the control module based on monitored parameters.

In an embodiment of the invention, the expander is a screw expander. The screw expander produces mechanical shaft power, which may be used to power a compressor, a pump or a generator. In either scenario, the speed control module may regulate operation of the screw expander through use of a throttle valve.

The system may further comprise a diverter valve and bypass loop for diverting organic propellant around the expander when the organic propellant is in saturated or liquid form, and the control module may activate the diverter valve to divert liquid propellant around the expander during start-up and shutdown of the organic Rankine cycle.

In an additional embodiment, there is further provided a recuperator for recovering thermal energy from organic propellant exiting the expander, which thermal energy is used to pre-heat organic propellant exiting the condenser or storage tank.

In a further embodiment, the control module further monitors and allocates power to system components as needed. The control module may dispatch a tertiary power source for allocation of tertiary power to the site.

In certain embodiments, secondary power may be mechanically coupled to a gas compressor, an electric generator, or a fluid pump.

In accordance with a second aspect of the invention, there is provided a system for providing power at a remote site comprising: a reciprocating engine for providing a primary power output; a Rankine cycle for collecting waste energy from the reciprocating engine and converting said waste energy to secondary power output; a tertiary power source; a control module, a monitoring module including a power demand module for sensing power demanded at the remote site and for communicating with the control module to activate the tertiary power source when the primary and secondary power outputs are not sufficient to meet the power demand. Power output from the primary and secondary power sources may also be monitored and controlled by the control module and a tertiary power source may also be recruited by the control module as necessary to provide supplementary power.

Tertiary power may be grid power or a generator, for example, and the primary power source may also be a generator.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

Embodiments of the present invention will now be described, by way of example only, with reference to the attached Figures, wherein.

DETAILED DESCRIPTION

Generally, the present invention provides a method and system to recover thermal energy from a reciprocating engine by operation of an associated organic Rankine cycle to produce a secondary power source. In operation of the Rankine cycle, a monitoring module senses one or more system parameters such as flow, pressure, and/or temperature, as well as ambient air temperature, and a control module adjusts operation of the system as needed to maximize output from the secondary power source.

In the embodiments illustrated in FIGS. 1 through 9, flow of organic propellant within the Rankine cycle is driven by a speed-controllable pump, with gaseous organic propellant passing through a screw expander 30 to generate the secondary power source. In some embodiments, propellant exiting the expander is passed through a recuperator to recover thermal energy. The propellant is then condensed by passage through a condenser 40 (which may be air-cooled or liquid-cooled), followed by recovery of thermal energy from the recuperator. The preheated propellant returns to the heat exchanger(s) to collect engine heat, converting the propellant again to gaseous state to be passed through the expander.

Secondary power may be produced by the expander as electricity or as mechanical shaft horsepower, and this secondary power may be used to directly operate other site equipment, may feed into a motor control centre to be used on site, or may directly supplement primary power generated.

A tertiary power source may also be present to supplement site power as necessary. The tertiary power source may be fed into a motor control centre to ensure that on-site power demands are met.

System Overview

Figure 1:
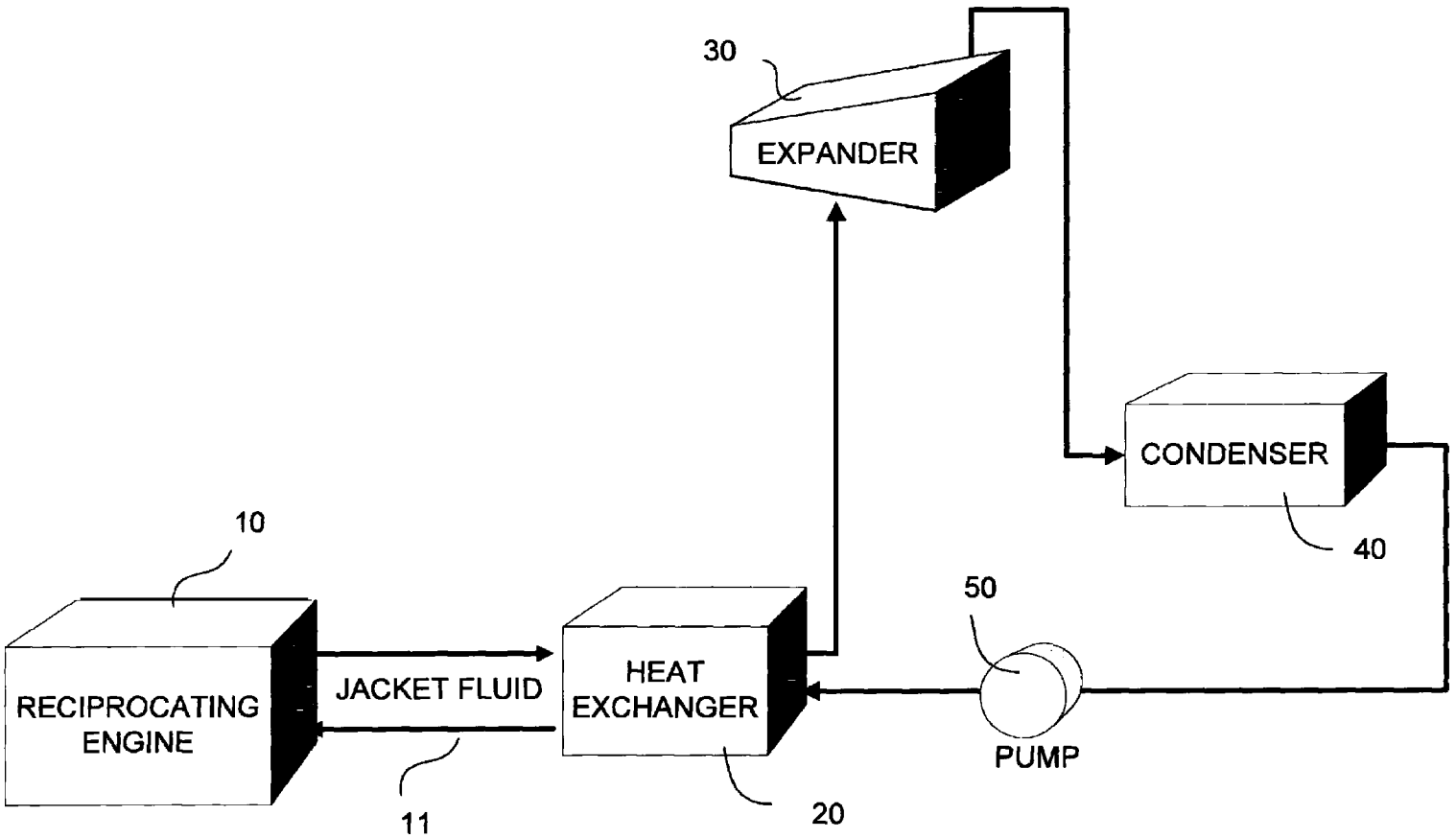
FIG. 1 is a schematic diagram of a system in accordance with an embodiment of the invention.

With reference to FIG. 1, a simplified thermal energy recovery system in accordance with an embodiment of the invention is shown. Reciprocating engine 10 provides a primary power source, and in addition releases thermal energy through engine exhaust and as radiant energy. The radiant energy is dissipated from the engine block by heat transfer within the engine jacket (housing) to a cooling fluid circulating within the engine jacket. The thermal energy collected by the jacket fluid 11 (typically a glycol and water mixture) is transferred to organic propellant within the Rankine cycle through heat exchanger 20. The liquid organic propellant is thereby evaporated and pushed through the expander 30 to generate a secondary source of power. Propellant leaving the expander is condensed at condenser 40 and passes through a pump 50 prior to returning to the heat exchanger 20 to repeat the Rankine cycle. A monitoring module and a control module 100, although not shown in all Figures, is included in each system described below to regulate various components and functions, as will be described.

Figure 2:
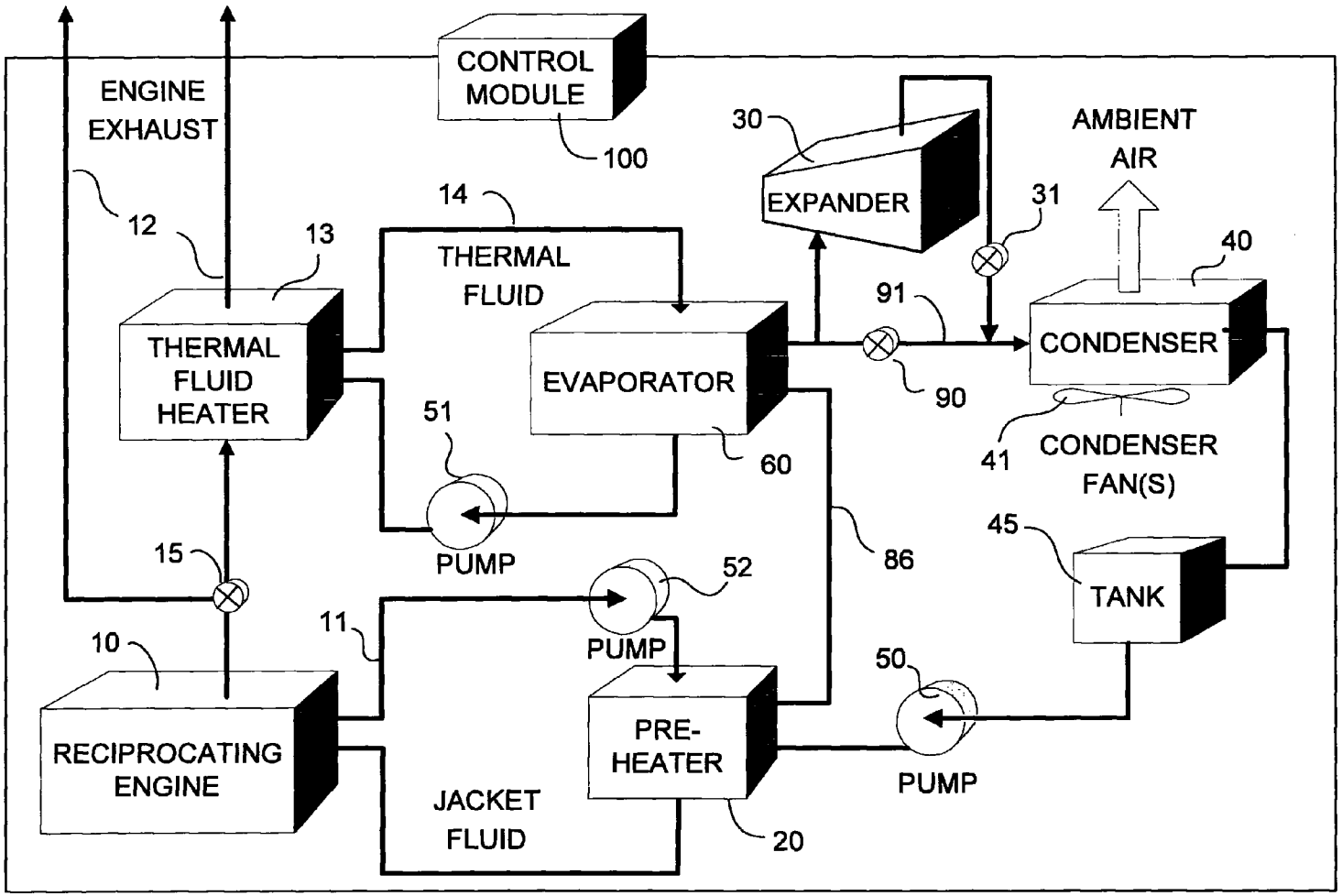
FIG. 2 is a schematic diagram of a system in accordance with another embodiment of the invention.

With reference to FIG. 2, a further system design is shown in accordance with an embodiment of the invention. Thermal energy is collected from engine jacket fluid 11, which thermal energy is transferred to organic propellant at heat exchanger 20. The preheated organic propellant may collect additional thermal energy from engine exhaust 12, through heat exchange with a thermal fluid circulating to and from the exhaust system, at evaporator 60. The use of a thermal heating fluid is preferred in collection of thermal energy from the engine exhaust 12 (which exhaust may reach temperatures in excess of the propellant flash temperature) to minimize the risk of fire or explosion. Further, the thermal fluid loop allows the ORC system to be located a reasonable distance from the reciprocating engine, as thermal fluid may easily be pumped through a piping system (insulated pipes in cold climates) with minimal thermal losses. As such, thermal energy from engine exhaust 12 is directed either to atmosphere or to the thermal fluid heater 13 by diverter valve 15. Thermal energy collected in the thermal heating fluid is transferred to organic propellant 86 at evaporator 60, with gaseous propellant passing to the expander 30, driving generation of secondary power. The spent propellant then passes to the condenser 40, and exits the condenser in liquid form to be returned to heat exchanger 20, and repeat the cycle. Although not shown in this figure, once the propellant is condensed into liquid, it is temporarily held in a storage tank before being pumped to the heat exchanger 20.

System Operation

Figure 3:
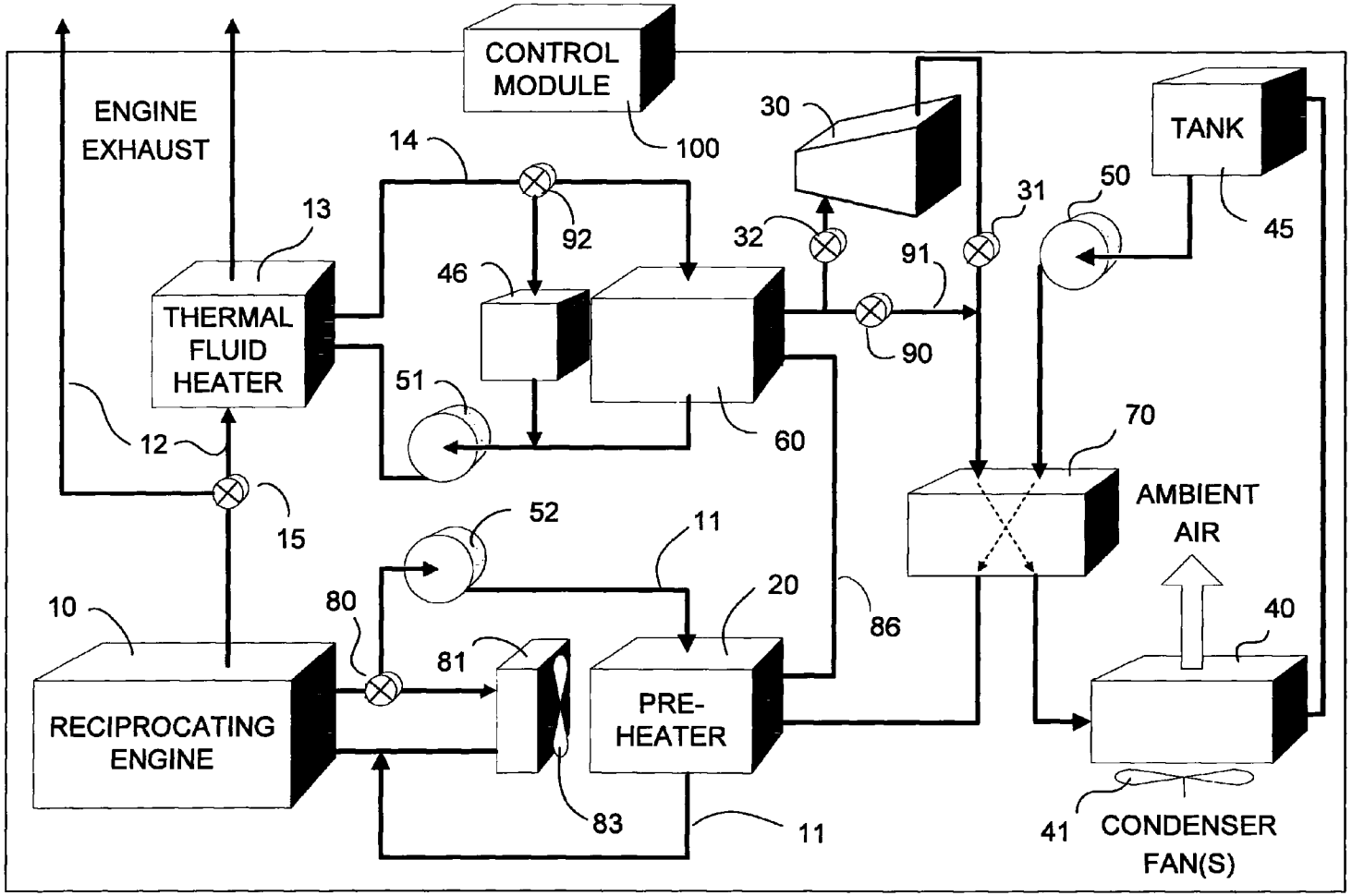
FIG. 3 is a schematic diagram of a system in accordance with a further embodiment of the invention.

Referring now to FIG. 3, which depicts a specific embodiment of the invention, a recuperator 70 exchanges thermal energy from the propellant exiting the expander 30 with cooled propellant from the condenser 40 or storage tank 45, preheating the liquid propellant before it reaches the preheater 20 which exchanges thermal energy between the engine jacket and the propellant.

Flow of propellant through the Rankine cycle may be adjusted by a control module 100, which may include a variable frequency drive to vary the operation of the pump 50. Alternatively, the pump 50 may be a multi-stage centrifugal pump that is adjustable directly by the control module 100. That is, the control module will receive a signal from the monitoring module that the pump needs to speed up. The control module will then send a signal to the VFD that controls the electric motor at the multi-stage pump, thereby adjusting the flow rate of the propellant. Temperature and pressure of the propellant may therefore be monitored at one or more locations within the cycle to determine the required propellant flow for current operating conditions. A liquid level switch may be present on either the pre-heater 20 or on the evaporator 60, which will be monitored by the monitoring system. When the level is low, the control module will increase the flow rate to send more propellant to the heat exchangers.

As a further example, in cold weather conditions, propellant passing through an air-cooled condenser may require only minimal forced air flow across the condenser, as the surface area of the condenser fin tubes permits a significant degree of thermal energy transfer with the ambient air. Similarly, in cold weather, less thermal energy may be available for collection from the engine 10. Therefore, in cold temperatures, the control module may simply decrease the flow of propellant through the Rankine cycle by adjusting the speed of pump 50 to permit sufficient time to heat and cool propellant within the cycle.

The rotational speed of the expander is controlled by operation of throttle valves 31, 32 (opening and closing to adjust propellant flow through the expander), regulated by a speed control module, which is monitored by the monitoring system. Cooling fans (if present) at the condenser may also be subject to the control module 100 such that fans are slowed, sped-up, or shut-down, depending on the outside ambient temperature.

Further, the control module 100 may include bypass valves 15 and/or 80 to divert engine thermal energy to/from the organic Rankine cycle system. Bypass valve 90 (if present), in combination with throttle valve 31 or 32, may divert heated fluids around the expander during start-up and shutdown of the Rankine cycle and/or engine. When de-activated, bypass 15 diverts engine exhaust gases to atmosphere rather than to the heat exchanger 13 and diverter valve(s) 80 diverts jacket water to the radiator 81. If required, thermal fluid circulating pump 51 and jacket water pump 52 may be sped-up or slowed-down by the control module 100 or shut down entirely. Similarly, with reference to FIG. 4, bypass 80 may be activated by the control module (not shown) to fully or partially divert jacket fluid to the engine radiator 81 (which is preferably inactive during operation of the Rankine cycle) rather than to the heat exchanger 20, and if required, jacket fluid booster pump 52 may be simultaneously adjusted to meet the required flow. Thus, organic propellant 86 passing through jacket heat exchanger 20 will not collect engine jacket heat as the jacket water in the heat exchanger will be stagnant. Similarly, the thermal fluid loop collecting engine exhaust 12 heat may be shut down by de-actuating valve 15 such that it diverts engine exhaust to atmosphere and if required, actuating valve 92 to dump thermal fluid from the thermal fluid loop to a storage tank and preventing operation of thermal fluid pump 51 so that propellant does not receive thermal energy from the thermal fluid loop. Therefore, propellant within the Rankine cycle will adapt quickly to the thermal energy added or removed from the system.

Bypass valve 90, if present, may also be activated in conjunction with throttle valve 31 during start-up and shutdown to direct propellant from the evaporator 60 directly to the recuperator, bypassing expander 30. Similarly, the recuperator may also be bypassed such that the propellant flows directly from the evaporator to the condenser. Bypass of the expander 30 prevents propellant from entering expander 30. This is desirable when the propellant is in liquid state, as entry of liquid propellant at high flow rates and pressures into the expander 30 may damage the internal components of the expander. Also, when the system shuts down and the propellant starts to cool, it contracts. Significant enough contraction could cause the expander to spin in reverse, potentially causing the generator to also operate in reverse. As an added measure, a check-valve or control module 100 may close the back-pressure throttle valve 31 to prevent this.

On system start-up, the expander may be bypassed by controlling valve 90 such that propellant is diverted to flow through bypass 91. It is generally desirable to maintain flow through the recuperator to speed heating of the organic propellant within the Rankine cycle system. In certain embodiments, such as use of a screw expander, such bypass may not be necessary, as a screw expander has robust internal components and can handle liquids flow at low pressure. In a start-up situation, propellant pump 50 may not be activated by the control module 100 to operate until the heat at the preheater 20 and the evaporator 60 are sufficient to boil any propellant that is in the evaporator at start-up. Either the pre-heater or the evaporator may have a level switch in it to send a signal to the monitoring module, which then sends a signal to the control module, which then controls the speed of the propellant pump. When the propellant level in the heat exchanger with the level indicator (pre-heater or evaporator) is high, the propellant pump slows down and when the level is low, the propellant pump 50 speeds up to send more propellant to the heat exchanger (pre-heater or evaporator). In a start-up situation, the level switch in the heat exchanger (pre-heater or evaporator) will read that the level is high and the pump will be inactive. Once the thermal energy from the engine heats up the propellant, the propellant will expand and flow towards the expander (because the propellant pump 50 is off and the throttle valve 31 will be open). Once the level in the level controlled heat exchanger (either the pre-heater or evaporator) gets low, the propellant pump will slowly start pumping fluid through the ORC such that the rate of boiling exceeds the rate of pumping, thereby insuring that any propellant entering the expander is in a gaseous or semi-gaseous state. Therefore, on start-up, the only liquid propellant that shall pass through the expander will be the propellant that was between the evaporator 60 and the expander 30, which condensed to liquid when the system was not operating. That fluid will be slowly moved through the expander in liquid state at a low pressure and low speed, thereby minimizing the liquid exposure to the expander.

EXAMPLES

A preferred system in accordance with the invention is intended for use with a reciprocating engine of the type commonly used to power electric generators or natural gas compressors, but is also useful with reciprocating engines that supply motive power to a vehicle, heavy equipment, or otherwise provide power to do useful work. Generally, the reciprocating engine is used to provide power in stationary applications for generating electricity and for compressing natural gas for pipeline transport, and the secondary power source is produced in the form of mechanical shaft horsepower by the expander. This mechanical shaft horsepower may be used to: 1) couple to a compressor to boost the inlet pressure of a primary compressor or to generically move gases (see FIG. 8); 2) couple to a pump to pump liquids (see FIG. 9); or 3) couple to an electric generator to produce electricity at grid-connected or remote sites where the electricity is then used to reverse feed the grid, supplement electrical demand on-site or power parasitic loads of the reciprocating engine or the ORC system. More specifically, the mechanical shaft horsepower may be used to compress gas as a boost compressor for the primary compressor, to supplement the mechanical shaft horsepower of the primary reciprocating engine, to pump liquids, or to generate electricity for any other local energy need. Thermal energy may be collected from one or more such engines and processes, with the system collecting thermal energy from all sources to provide further efficiencies in the operation of the Rankine cycle to produce secondary power.

Suitable organic propellants for use within Rankine cycle systems are known in the art, and generally include branched, substituted, or aromatic hydrocarbons, and organic halides. Suitable propellants may include CFCs, propanes, butanes, or pentanes. Preferably, the propellant is butane, pentane, isobutane, R-134, or R-245fa.

Thermal energy is preferably collected from the engine jacket fluid 11 and from engine exhaust 12. In most reciprocating engines, jacket fluid typically circulates about the engine and is directed to a radiator 81, where this radiant heat is dissipated to atmosphere by blowing ambient air across the radiator using a fan 83. In such system, the jacket fluid is instead directed to heat exchanger 20 during organic Rankine cycle operation, where the jacket fluid is cooled by exchange of thermal energy with liquid organic propellant that is at a cooler temperature than the jacket fluid, thereby pre-heating the organic propellant before it reaches the evaporator 60. The rate of thermal energy exchange may be controlled to some extent by controlling the speed and pressure of the jacket fluid by controlling pump 52 using a variable frequency drive control device, and using diverter valve 80 to divert the jacket water to the radiator as necessary. For example, the pump may be operated at a higher speed in hot conditions to prevent overheating of the reciprocating engine, while in cool conditions, the pump may be operated at slower speeds. When the ORC system is operational, diverter valve 80 directs jacket fluid to the radiator 81 in conditions when thermal energy exchange with cooler organic propellant is not desirable, or is not effective to sufficiently cool the reciprocating engine 10.

The reciprocating engine exhaust loop carries thermal fluid 14 between the exhaust system and the evaporator 60. Use of thermal fluid in this loop is preferable due to its stability even in the presence of high temperatures and sparks that may be present within the engine exhaust system. That is, if thermal fluid were to leak into the exhaust piping, it would burn off within the exhaust stack. By contrast, a propellant leak within the exhaust piping may cause a fire or even an explosion. Suitable thermal fluids for use within the thermal fluid loop are typically mineral oils or synthetic oils (for higher temperature applications). These oils are generally formulated from alkaline organic or inorganic compounds and are used in diluted form.

The engine exhaust can be directed to the thermal fluid heater 13, or diverted past the thermal fluid heater (the organic Rankine cycle system) and vented to atmosphere. When the thermal energy from the engine exhaust 12 is required, diverter valve 15 will: 1) simultaneously start closing flow to atmosphere and start opening flow to the thermal oil heater 13 or 2) start opening flow to the thermal oil heater 13 and then start closing the flow to atmosphere, as regulated by the control module 100.

The thermal fluid cycle pump 51 driving the thermal fluid loop may also be controlled by the control module 100 using a variable frequency drive control device as needed. In situations when the organic Rankine cycle is inoperative due to shutdown or failure of the ORC or reciprocating engine, the exhaust diverter valve 15 will divert the hot engine exhaust 12 to atmosphere and the thermal oil circulating pump 51 may be turned down and valve 92 closed to divert thermal fluid into the storage tank 46. Another option is to shut down the entire thermal fluid system to avoid supplying any residual thermal energy already present in the thermal fluid to the evaporator 60.

Evaporator 60 is a heat exchanger through which energy from the engine exhaust heat 12, collected and transferred within the thermal fluid 14, is transferred to the preheated organic propellant 86. As engine exhaust 12 may reach temperatures in excess of 1200 degrees Fahrenheit, a steady supply of such thermal energy is readily available for use in evaporating the organic propellant. However, rather than passing preheated organic propellant about the engine exhaust system directly (which bears the risk of propellant leaking from the heat exchanger into the exhaust system and causing a fire or an explosion), the evaporator and thermal fluid loop are present to effectively reduce this risk through physical separation, while still supplying sufficient thermal energy to evaporate the organic propellant. Further, the thermal fluid thermal energy transfer loop permits thermal energy from the engine exhaust to travel a significant and safe distance (in insulated pipes) from the engine prior to being transferred to the organic propellant. Without this physical separation, either the evaporator and additional ORC components would need to be located immediately adjacent to the engine to prevent loss of exhaust heat (which is not practical or possible in many situations), or the propellant would lose energy as the distance between the evaporator and expander increased. Thus, in the system shown in FIG. 3, preheated organic propellant enters evaporator 60 in a saturated or liquid state, and collects sufficient thermal energy from the thermal fluid 14 loop to evaporate the propellant into a saturated or super-heated gaseous state, which exits evaporator 60 in a gaseous form. Hot thermal fluid 14 may be diverted to a storage tank 46 when the Rankine cycle is not operating.

The gaseous propellant is then used to produce mechanical energy as a secondary power source by expanding the gaseous propellant within expander 30. As it is desirable that the propellant should enter and exit the expander in gaseous form, appropriate sensors and controls are present at the expander 30 to allow the control module 100 to monitor and adjust the rate of thermal energy entering the ORC system, air flow across the condenser, propellant flow and back pressure by the throttle valve 31 (used to control the rotational speed of the expander so that the shaft speed can be used to generate electricity or match the rotational speed of the primary power source) through the expander. Information from these sensors may also be used in the control of propellant flow within the Rankine cycle by adjusting pump 50 or the back pressure throttle valve 31. If necessary, diverter valve 90 may be activated to direct propellant through bypass loop 91 when secondary power generation is not necessary, or to divert liquid propellant from entering the expander 30. In addition to diverting the propellant within the ORC, engine thermal energy may be diverted to atmosphere, by directing jacket fluid to the radiator 81, and by diverting engine exhaust to atmosphere.

In a preferred embodiment, the expander 30 is a screw expander. A screw expander typically has 75-85% efficiency, is easily controlled, is robust, and may be used with a variety of temperatures, pressures and flow rates. Moreover, although typical turbine blades may sustain damage upon contact with condensed/saturated droplets of propellant, the large diameter steel helical screws of a screw expander provide a robust mass and surface capable of withstanding temporary exposure to liquids. Therefore, use of a screw expander will improve the overall efficiency and integrity of the system. Throttle valves 31, 32, may be placed immediately before and/or after the screw expander to control the speed of the expander shaft, by controlling the propellant flow and pressure across the expander. When the throttle valve 31 is used alone to control the speed of the expander shaft by creating back pressure of propellant within the expander, the control module will regulate the propellant pump 50 by signals from the liquid level in the heat exchangers such that the pressure and flow of propellant entering the expander 30 may fluctuate due to the pump fluctuating and therefore the throttle valves 31 or 32 will have to adjust the speed of the expander shaft to support the degree of back pressure applied by the throttle so as to maintain a suitable/preferred pressure differential.

A recuperator 70, as shown in FIG. 3, is preferably included to reabsorb much of the thermal energy that is not dissipated at the expander before it reaches the condenser, thereby improving efficiency of the system and increasing secondary power generation. Cooled propellant from the condenser is passed through the opposing side of the recuperator 70 to add thermal energy to this propellant that is en route to the pre-heater 20.

System Control

The control module 100 for use in accordance with an embodiment of the invention includes a monitoring module that monitors the temperature and/or pressure of propellant within the system and the control module adjusts the parasitic loads of the system as needed to improve efficiency and maximize secondary power generation. Suitably, a temperature sensing device and/or a pressure sensing device are placed at the expander and/or condenser to enable monitoring of the physical state of the propellant at these locations. Preferably, such devices are placed at each of the expander 30 and condenser 40 to enable monitoring of the physical state of the propellant at both locations. The control module may adjust: the propellant pump 50 speed, fan speed at the condenser if air-cooled, pump speed if liquid-cooled, diverter valve 15 at the exhaust bypass, speed of pump 51 of the thermal fluid pump, diverter valve 80 at the jacket water bypass, or speed of pump 52 of the jacket fluid pump to ensure that propellant entering the expander is gaseous, and propellant exiting the condenser is liquid.

The control module 100 may be manual, but is preferably automated, including a processor for collecting and processing information sensed by the monitoring module, and for generating output signals to adjust flow of propellant through the system, activate bypass valves, and adjust pump and fan speeds as necessary. These adjustments may be made through use of relays or through use of variable frequency drives associated with each component. The processor may further collect information regarding primary and secondary power output and may activate a tertiary power source when more power is required.

Notably, the amount of thermal energy collected from the engine 10 body may be adjusted by the control module by varying the flow of fluid through the engine jacket heat exchanger by diverting it to the radiator 81. Similarly, the amount of thermal energy collected from the exhaust system 12 can be varied by regulating the exhaust diverter valve 15, such that the exhaust energy can be diverted to atmosphere or to the thermal fluid 14 through heat exchanger 13. Further, the amount of thermal energy transferred from the thermal fluid 14 to the organic propellant 86 may be varied by adjusting the flow rate of thermal fluid through the thermal fluid system by circulating pump 51, or by temporarily diverting thermal fluid to a holding tank 46. This is particularly useful during start-up and shutdown of the system as the system may be heated and cooled quickly in a systematic manner. Using a screw expander to create mechanical shaft horsepower within the Rankine cycle further improves the robust nature of the system, which is particularly beneficial during start-up and shutdown. Specifically, as the screw expander will tolerate temporary passage of liquid propellant, system start-up and shutdown are greatly simplified. On start-up, the control module 100 is programmed to add engine thermal energy to the system without circulating propellant 86 until the liquid propellant 86 in the engine-associated heat exchangers reaches its operating temperature. At this point, the circulating pump 50 is started at slow speed to ensure that propellant 86 is sufficiently heated within the engine-associated heat exchangers 20 and 60 to evaporate the propellant prior to reaching the expander. In this manner, only a minimum amount of liquid propellant (in the piping between the evaporator 60 and the expander 30) will pass through the expander 30 on start-up, eliminating the need for bypassing the expander on start-up. Thus, the Rankine cycle is quickly operational upon pump 50 start-up and thermal energy may be collected and used for secondary power generation in accordance with the invention.

Figure 4:
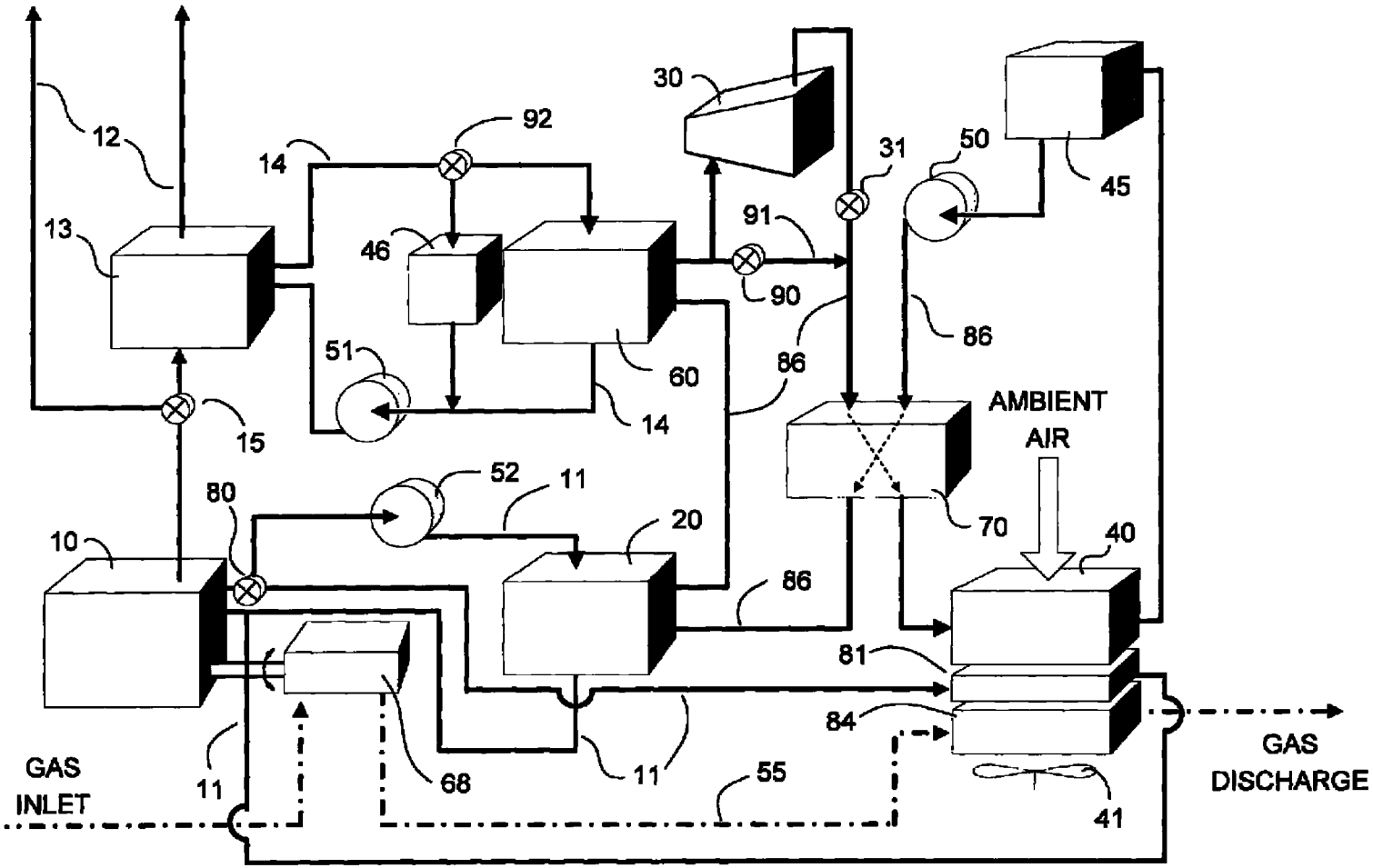
FIG. 4 is a schematic diagram of a system in accordance with a further embodiment of the invention.
Figure 5:
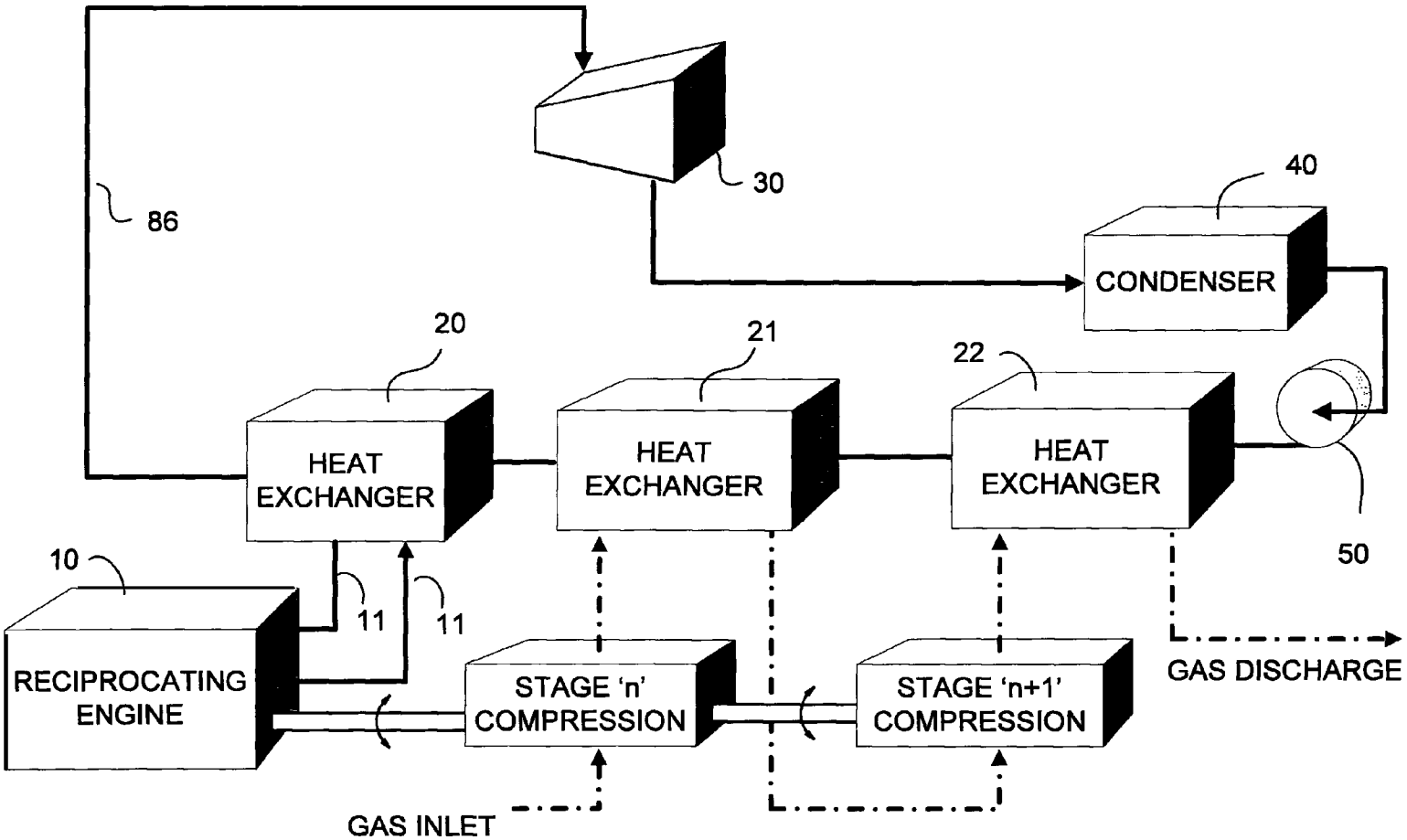
FIG. 5 is a schematic diagram of a system in accordance with a further embodiment of the invention.
Figure 6:
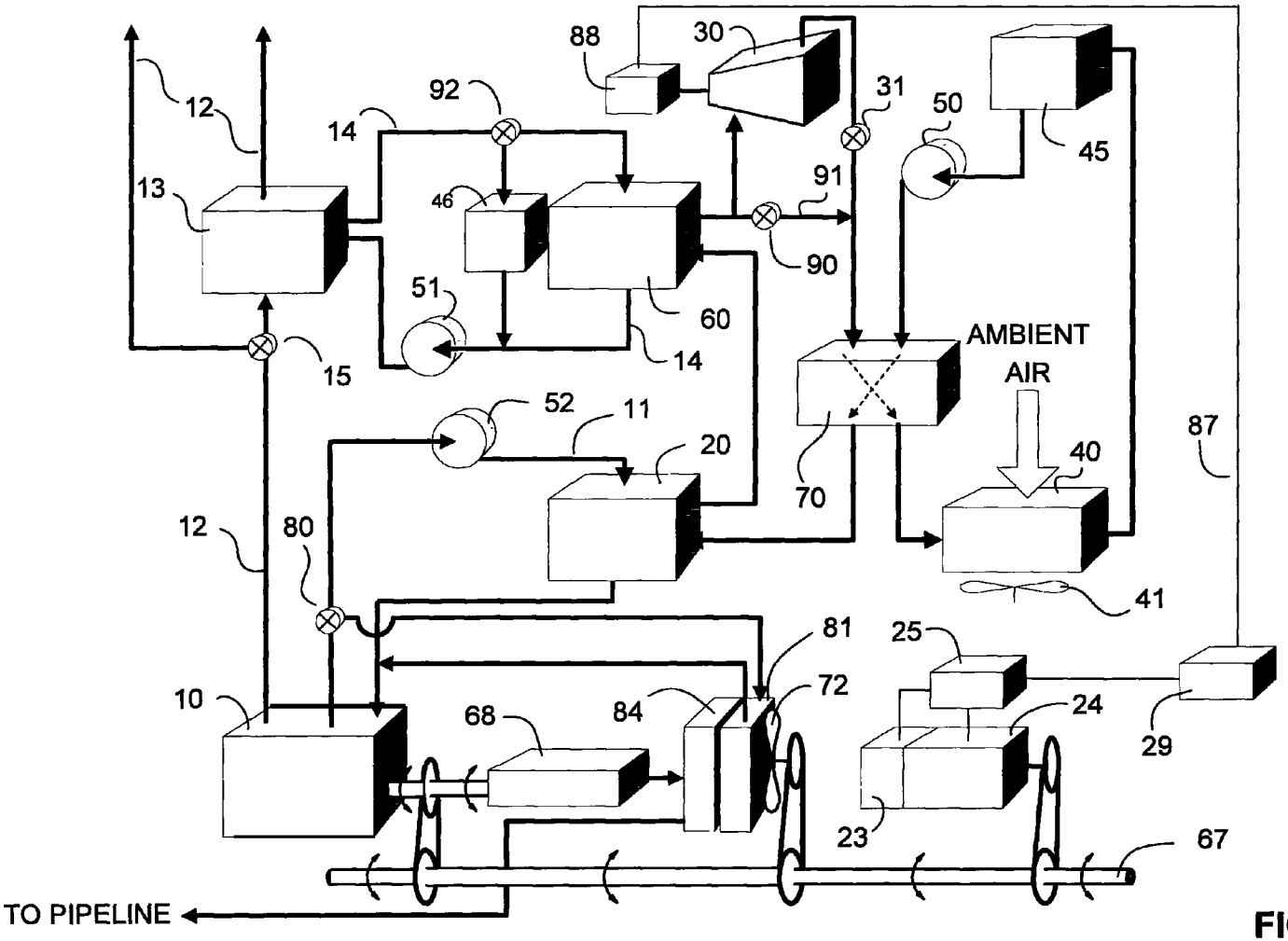
FIG. 6 is a schematic diagram of a system in accordance with a further embodiment of the invention.

With reference to FIGS. 4 through 9, the engine may be used to power natural gas compression. In these embodiments, further thermal energy may be recovered from one or more of the gas compression stages, as each stage of gas compression generates a significant amount of thermal energy that must be removed from the gas before the gas enters the pipeline system. Typically, the engine jacket water is cooled in an air cooled radiator 81 and the natural gas is air-cooled after each stage of compression in gas coolers 84. As shown in FIG. 6, the gas coolers 84, when co-located together with the radiator 81, are referred to as an "aerial cooler" (an air-cooled fin-tube configuration including a common fan 72 that blows air across both sets of the fin-tubes), and engine exhaust is vented to atmosphere. Instead of simply dissipating this heat to atmosphere, the thermal energy generated from the exhaust, the jacket water, and each stage of gas compression may be collected within heat exchangers 13, 20, 21, and 22 and used to heat organic propellant between the condenser and the expander, as shown specifically in FIG. 5, 6 and 7. This recovered thermal energy will result in additional secondary power generation, which power may be used to further improve system efficiency. Moreover, as shown in FIG. 4, the gas cooler 84 may be co-located with air-cooled condenser 40 and with radiator 81 to permit cooling by one set of fans 41 operated by the control module 100.

Figure 7:
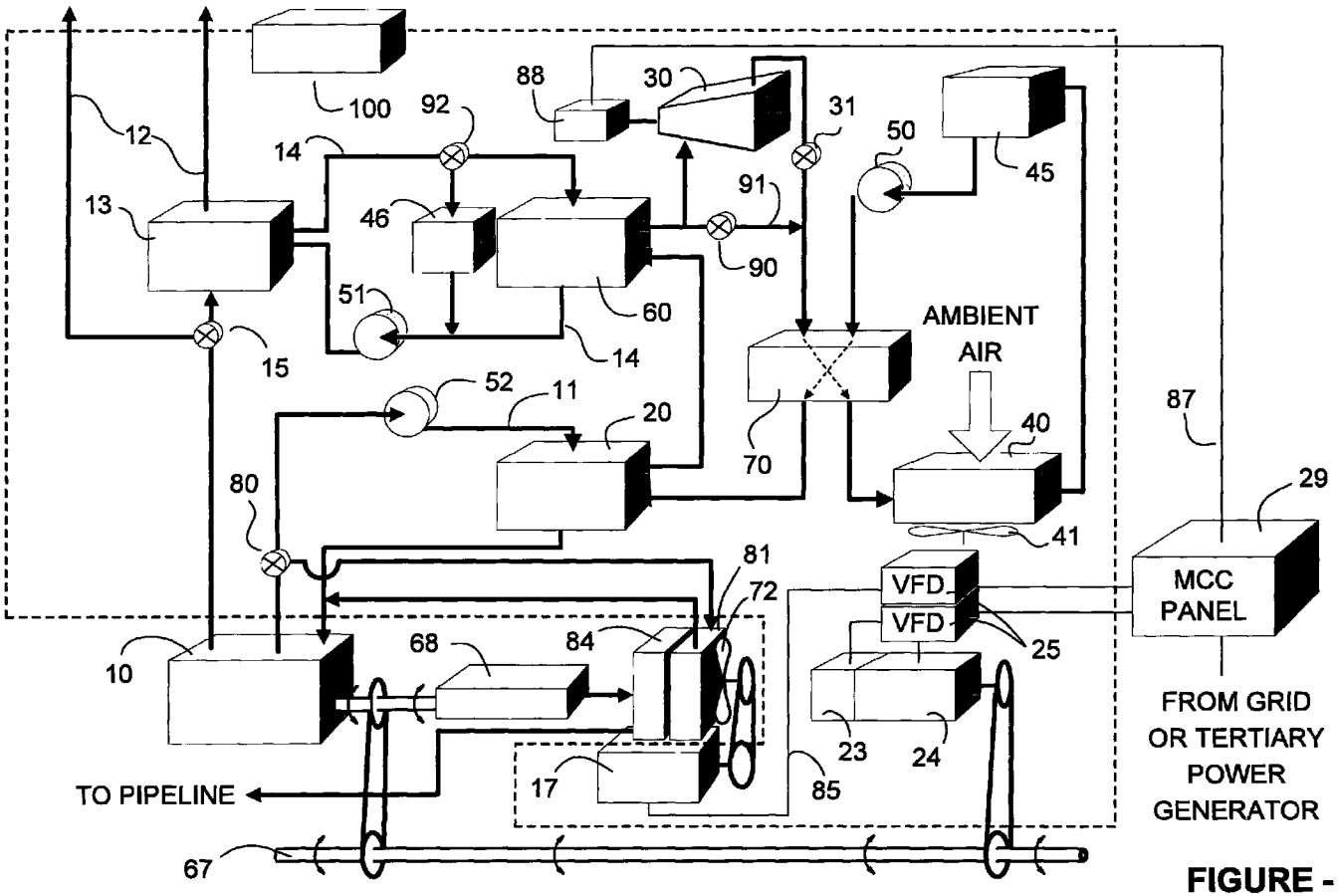
FIG. 7 is a schematic diagram of a system in accordance with a further embodiment of the invention.
Figure 8:
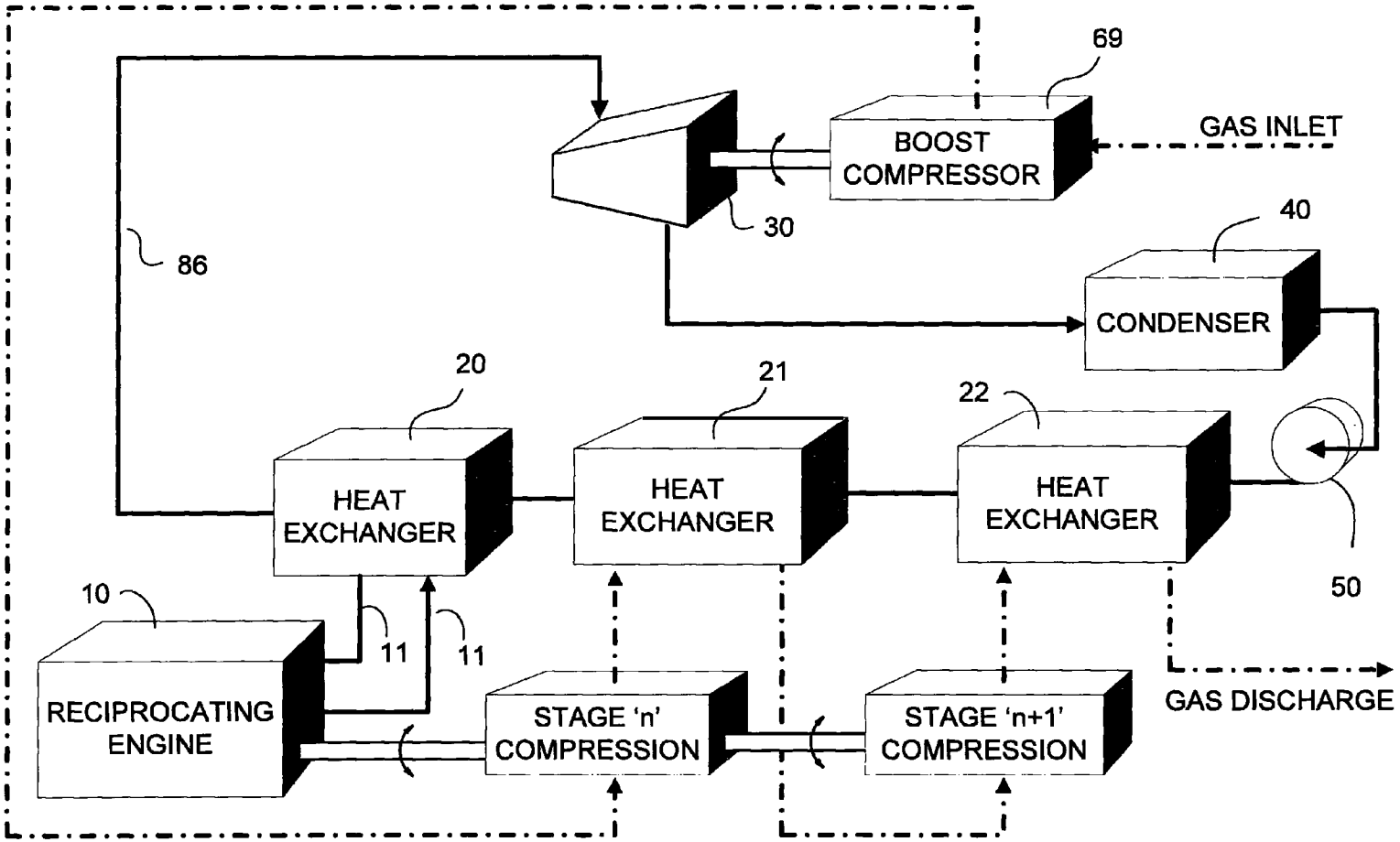
FIG. 8 is a schematic diagram of a system in accordance with a further embodiment of the invention.
Figure 9:
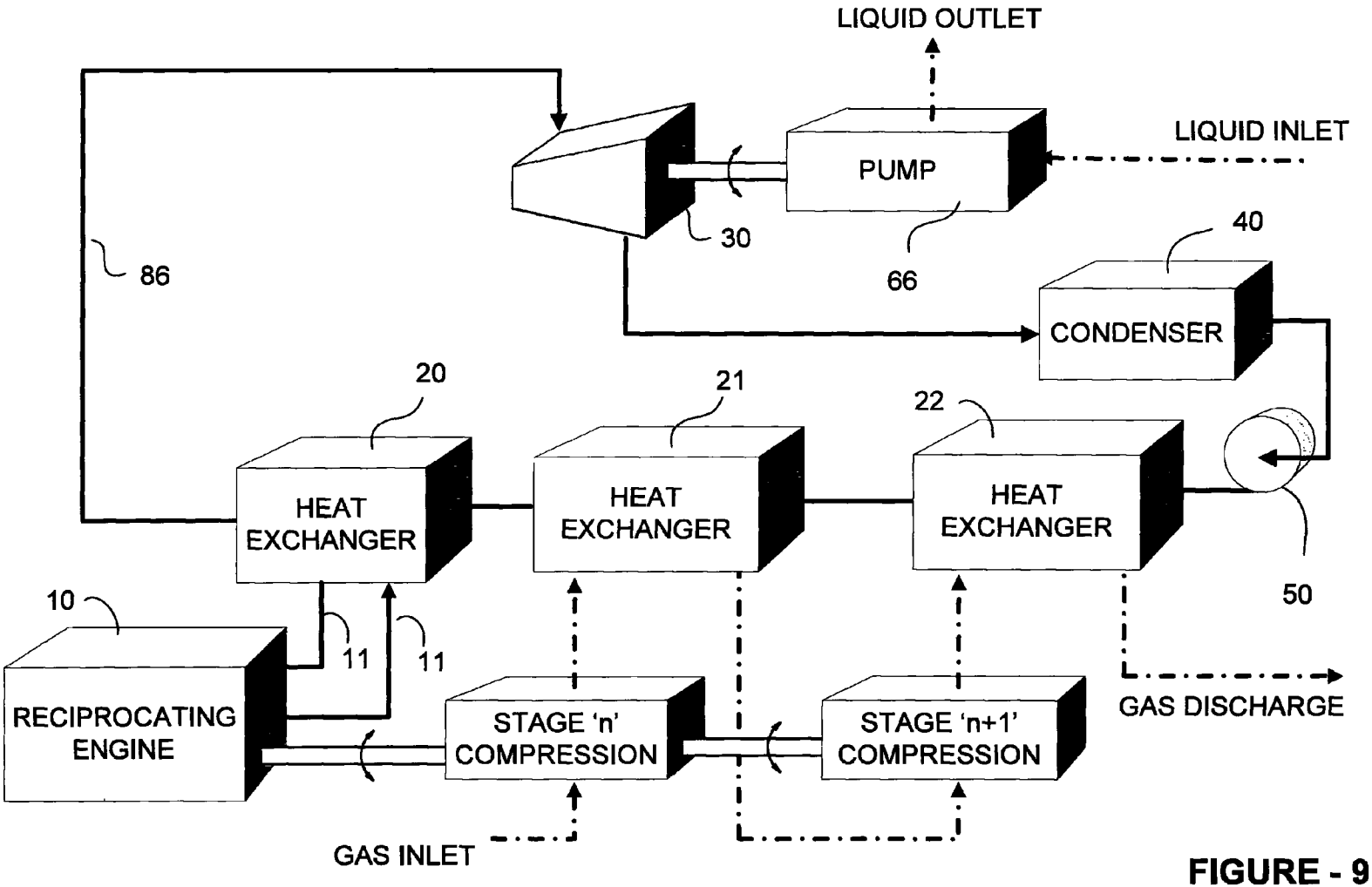
FIG. 9 is a schematic diagram of a system in accordance with a further embodiment of the invention.

As cooling fans 41 and 72 are a major parasitic load within the system, the control module is programmed to reduce fan speed whenever possible, for example in cool weather. This is accomplished by providing an electric fan with a variable frequency drive, or by providing a multi-speed fan operated directly by the control module. In typical gas compression configurations, the associated aerial cooler fan 72 is often powered through a jack-shaft coupled to the primary engine's crank shaft via a series of shafts and pullies (as shown in FIG. 6), drawing horsepower directly from the primary engine. Similarly, a reciprocating engine coupled to a generator is typically associated with a belt-driven radiator fan 83 (as shown in FIG. 3). As depicted in FIG. 7, an opportunity exists to de-couple the fan 72 from the jack-shaft 67 and drive fan 72 directly with an electric motor 17, that is controlled by the control module 100, by feedback from the monitoring module which utilizes a VFD 25 (or as a controllable multi-speed fan) to control its speed. The power load of fan 72 is now being supplied by the secondary power source, thereby reducing the load on the primary engine. The reciprocating engine may therefore use less fuel to produce the same amount of net horsepower, or conversely, may consume the same amount of fuel with more primary power output.

Any power generated that is not consumed in motor 17 to drive the fans 72 can be transferred to the jack-shaft 67 via electric motor 24 which has a speed sensor 23 to match the rotational speed of jack-shaft 67 so that the surplus power available can be utilized to assist the primary engine in driving the compressor (or whatever the primary reciprocating engine may be doing—generating power, etc.). As explained above, the result is that the reciprocating engine 10 will consume less fuel to compress the same amount of natural gas or the reciprocating engine will now have additional horsepower capacity to drive compressor 68 so that it can compress more gas on the same amount of fuel that was previously consumed.

With specific reference to FIG. 6, a suitable configuration is shown in which the aerial cooler/radiator fan 72 is mechanically connected to the jack-shaft 67 of the reciprocating engine 10, which is further connected to an additional electric motor 24. Motor 24 is equipped with an encoder 23 which monitors the speed of the jack-shaft 67, and then communicates with variable frequency drive 25 to apply the right amount of torque at the matching speed to supplement the mechanical shaft horsepower and speed of the jack-shaft 67, or the reciprocating engine 10 as necessary.

The electric motor 24 may be supplied with secondary power from the Organic Rankine Cycle, or by an independent, tertiary, power source. Thus, once the ORC system is established, parasitic loads on the engine (such as the fans used in gas compression cooling and radiator cooling) may be balanced directly with supplemental torque from the electric motor 24, either through use of secondary or tertiary power. This will reduce: engine load (which reduces fuel consumption), grid-based power usage, and engine maintenance while maintaining a constant level of total power output and rate of natural gas compression.

Conversely, if the engine load is maintained, (which maintains fuel consumption), then the engine maintenance will also be maintained while the total power output from the primary engine 10 is increased and rate of natural gas compression is thereby increased. The control module 100, through the monitoring module, monitors the jack-shaft 67 speed via encoder 23 and regulates the amount of torque provided by the electric motor 24 to achieve these endpoints. Any secondary power not required by the electric motor may be diverted elsewhere on site or to the grid, if applicable.

Computer modelling suggests that fuel consumption of the gas compressor may be reduced by approximately 5% by simply converting the propulsion of the aerial cooler fan 72 to be propelled by an electric motor 17 monitored by the monitoring module and controlled by the control module 100 to provide adequate cooling. Accordingly, this reduces the load on the engine by approximately 5%, thereby providing capacity for the primary engine to produce more power with the same amount of fuel, or to reduce fuel consumption. In addition, if more horsepower is produced by the secondary source than is required to run the system parasitic loads, for example the aerial cooler fan 72, the supplemental mechanical shaft horsepower may be used to assist the recip engine in driving the compressor 68, or to supplement further crank-shaft dependent or parasitic loads within the system.

Ultimately, the control module 100 in conjunction with the monitoring module, controls recovery of thermal energy from the primary power engine 10 and uses this thermal energy to create a secondary power source. The control module is programmed to maximize net horsepower. For example, in some circumstances, more net horsepower may be produced by reducing parasitic loads within the system, while in other circumstances more net horsepower may be produced by maintaining or increasing parasitic loads and driving secondary power generation. The monitoring module and control module therefore work together to reallocate thermal energy from the jacket water and the engine exhaust, determining the optimal parasitic loads on the ORC system in order to further maximize secondary power generation as necessary. In all embodiments, the reciprocating engine 10 operates at a given capacity, and the inherent operational requirement for removal of engine thermal energy is achieved by some combination of: diversion of exhaust gases to atmosphere; cooling of the engine by its radiator fluid loop; collection of exhaust heat for use within the ORC system; and collection of engine jacket radiant heat for use in the ORC system.

The reciprocating engine may be used to drive an electric generator in remote locations where or when grid power is not available, or where use of grid power is undesirable. The secondary electric power or mechanical shaft horsepower generated by the ORC system may be used to: supplement the primary power created by the reciprocating engine; supplement the parasitic loads of the ORC system; or to offset usage of tertiary power.

The control module is programmed based on tabular data that has been compiled by running simulation software designed to optimize power output. That is, various possible readings from the associated monitoring module (for example ambient air temperature or temperature/pressure of propellant) are initially compared to the optimized tabular results and corresponding adjustments are made to the ORC system to see if these alternations improve the net horsepower output of the system. The complete data set of such readings and corresponding optimized operating conditions are loaded into the control module to enable the system to quickly settle into optimal operating condition in any situation. As the system gathers operating data and the system performance is compared to that of the simulated operation, adjustments to the programming of the control system may be made to get the best results through the iterations previously encountered.

When the system is generating secondary power as electricity, for example, the secondary power generated is sent to a motor control centre or power hub 29 (as shown in FIG. 6 and FIG. 7), which also receives power from any other sources (the reciprocating engine coupled to a generator, grid, tertiary source, etc) and allocates power on demand. When the parasitic loads of the ORC system and other power loads is not satisfied by the primary and secondary power sources alone, the motor control centre 29 may indicate to the demand module, which then corresponds with the control module 100, that the tertiary power to the site should be dispatched to start generating power.

In a specific example, the reciprocating engine may be used to compress natural gas, with secondary shaft HP used to: 1) power a boost compressor that boosts the inlet gas pressure of the primary compressor 68, 2) power a pump that can be used to re-inject produced water, 3) power a generator, or 4) supplement the output of the primary source or its parasitic loads.

In certain situations, particularly in remote locations, a demand for power exists in operation of a work site. Notably, the demand may fluctuate from time to time. As such, a tertiary power source may also be available, such as a generator, solar power, wind, fuel cell, or grid power. This tertiary source of power may be operated as the main source of power on the site with the reciprocating engine and the secondary power utilized as additional power. In some cases, the power generated by the engine and secondary power source may not be sufficient to meet the needs of the job site and therefore an additional fuel based tertiary power source may be required to be dispatched so that the site demand can be met.

Accordingly, the control module 100 may also initiate alterations in performance which may require tertiary power. However, in certain embodiments, tertiary power should only be accessed when necessary to ensure an uninterrupted supply of power to the site. Usage of the tertiary power source will increase the operating cost of the site, however: 1) the overall cost of power will be reduced as power may be supplied by the thermal energy recovery system in place of fuel-fired generators; and 2) in many off-grid locations the total operating cost is less important than providing a reliable level of power at the site.

The above-described systems are particularly advantageous in that they are operable at low temperatures and pressures, allowing the use of relatively inexpensive components. Standard pressure configurations for valves, pipes, fittings, etc. are 150 psi, 300 psi, 600 psi, and 900 psi. The present system is capable of operating all components of the system under 300 psi (with the majority of components operating under 150 psi) to maximize versatility of the system, and to minimize costs.

Notably, a screw expander is well suited to operate on reduced pressure differential with an increased flow rate. Computer modelling demonstrates that this reduced pressure differential only trivially reduces net horsepower output (due to the slight increase in pump parasitic load necessary to move more propellant), because screw expanders use a rotary type positive displacement mechanism rather than turbo-expanders, which are centrifugal or axial flow turbines. Specifically, the top-end pressure is lower and therefore less horsepower is required to drive the propellant to maximum pressure, however slightly more horsepower is required to move the increased fluid volume. By reducing the operating pressures and temperatures, computer modelling demonstrates that a wide variety of organic fluids are suitable for use within the present system, some of which would otherwise not be as feasible with turbo-expander based ORC systems.

Control Example

With respect to specific control of the ORC system, the ORC system is primarily driven using ambient air temperature as the independent variable. Based on the information gathered by the monitoring module, such as ambient air temperature, and knowing the surface area of the air-cooled condenser 40 fin-tubes as well as the amount of air that can be moved across the fin-tubes by the fan system 41, the degree of propellant 86 condensing can be calculated by the control module 100, using standard calculations. As the upper limit of propellant cooling is determined by the ambient air temperature, surface area of cooling fins, flow of ambient air movement, and pressure, and how these factors relate to the propellant flow rate, temperature and pressure at which the propellant enters the condenser, the degree of propellant cooling/condensation may be adjusted by adjusting the speed of the propellant pump 50, adjusting the pressure across the expander 30 via a combination of throttle valves 31 or 32 and the propellant pump pressure, or a combination of adjusting both propellant pump speed 50 and the pressure across the expander 30.

Alternatively, the thermal energy input may be adjusted by controlling the rate of: 1) exhaust flow 12 to the thermal fluid heater 13, which then transfers thermal energy to the thermal fluid 14 within the thermal fluid loop and/or 2) the jacket fluid 11 loop. The control module 100, in conjunction with the monitoring module, therefore determines all possible schemes by which the degree of propellant cooling may be adjusted and calculates the anticipated parasitic loads and hence net power output. The system implements the scheme and maximizes net power output by making the appropriate system adjustments.

Alternatively, the system may be programmed to automatically implement various schemes when certain combinations of monitored parameters are identified. For example, the ORC system may be allowed to operate, with the control module reacting to ensure that the propellant leaving the condenser is liquid and the propellant entering and exiting the expander is gas. As the system may be constrained by the ability to condense propellant (whether air cooled condensing or cooling water), the monitoring and control module logic would maximize condensing medium and if unable to maintain propellant condensation, the input thermal energy from the engine will be curtailed by dumping the excess heat to atmosphere.

It is recognized that in the above example, propellant condensation ability will be the limiting factor in taking on additional thermal energy inputs. As thermal energy input to the system is increased, the condenser fan speed will continually be increased until it is at its maximum air flow. If this maximum flow cannot condense all of the propellant being pushed through the condenser, the control module will either divert some engine heat to atmosphere, or reduce the flow of propellant in the ORC system. If this adjustment is not sufficient (for example, when ambient temperatures are high), then engine exhaust may also be diverted by the control module to avoid thermal energy collection from this source.

Further, if removing the engine exhaust thermal energy is not sufficient to condense the propellant exiting the air cooled condenser, then the flow of jacket water to the pre-heater will also have to get curtailed by the control module 100, until the ORC system is able to condense all propellant.

Similarly, the system is also driven by temperature and/or pressure measurements by the monitoring module at the expander 30 to ensure propellant 86 entering the expander is in gaseous state. When more thermal energy is required to evaporate the propellant 86, the propellant pump 50 speed may be altered to allow more thermal energy transfer from the engine jacket 11 and exhaust 12. Similarly, the speed of the thermal fluid loop and jacket fluid loop may be controlled to supply more or less thermal energy to the heat exchangers 20, 13 and 60.

As a further example, in very hot ambient temperatures, the air-cooled condensers 40 may be running maximally to cool the propellant, which may still be insufficient for condensation of propellant. The thermal energy entering the system via the jacket water or engine exhaust should then be curtailed, for example by diverting engine exhaust 12 to atmosphere, reducing the flow of thermal fluid 14, altering the pressure differential across the expander by use of the throttle valve 31, and/or jacket fluid 11 to the heat exchangers.

The above-described embodiments of the present invention are intended to be examples only. Alterations, modifications and variations may be effected to the particular embodiments by those of skill in the art without departing from the scope of the invention, which is defined solely by the claims appended hereto.

What is claimed is:

1. A system for controlled recovery of thermal energy from a natural gas compression module powered by a reciprocating engine, the natural gas compression module comprising one or more compression stages for compressing natural gas flowing within a pipeline and conversion of said thermal energy to mechanical energy, the system comprising:

a. a natural gas compression module and a reciprocating engine operable to provide a primary power source and a one or more sources of thermal energy;

b. a circulating pump, at least one propellant heat exchanger, an expander, and a condenser, arranged to operate an organic Rankine cycle in which thermal energy is collected from the engine and from the natural gas compression module and is transferred to a liquid organic propellant in the at least one propellant heat exchanger to evaporate the propellant, which gaseous propellant then drives the expander in production of mechanical energy to create a secondary power source, for use in powering at least one system parasitic load with spent propellant from the expander condensed back into liquid form by the condenser for reuse within the organic Rankine cycle;

c. a sensor for measuring at least one of: temperature: pressure; and flow of organic propellant within the Rankine cycle;

d. and a control module for regulating operation of the Rankine cycle based on said sensor measurements, to optimize power generation by the secondary power source.

2. The system as in claim 1, wherein thermal energy is collected from the reciprocating engine by circulation of fluid about an engine jacket of the reciprocating engine, which thermal energy is transferred from the jacket fluid to the organic propellant at the propellant heat exchanger.

3. The system as in claim 2, wherein the control module regulates the flow of jacket fluid between the engine and the heat exchanger to control the amount of thermal energy collected from the engine for use within the organic Rankine cycle.

4. The system as in claim 2, further comprising a jacket fluid diverter valve for directing engine jacket water to the engine jacket fluid heat exchanger or to an engine radiator.

5. The system as in claim 2, further comprising a second propellant heat exchanger, wherein additional thermal energy is collected from the reciprocating engine by circulation of thermal fluid about a thermal fluid heat exchanger within the engine exhaust system, with said additional thermal energy transferred to the organic propellant at the second propellant heat exchanger.

6. The system as in claim 5, wherein the thermal fluid comprises water, glycol, a mineral based thermal oil or a synthetic based thermal oil.

7. The system as in claim 5, further comprising an exhaust diverter valve for venting engine exhaust gas to atmosphere, wherein the control module regulates operation of the exhaust diverter valve to regulate the amount of thermal energy from the exhaust that is transferred to the thermal fluid for use within the organic Rankine cycle.

8. The system as in claim 1 wherein the sensor is an ambient air temperature sensor.

9. The system as in claim 1, wherein the control module comprises a processor for processing sensor measurements to determine the physical state of the organic propellant.

10. The system as in claim 1, wherein the control module compares sensor measurements to previously simulated performance schemes stored in the control module, and sends an adjustment signal to at least one system component.

11. The system as in claim 10, wherein the adjustment signal results in a reallocation of system power.

12. The system as in claim 10, wherein the adjustment signal effects a change in; rate of heat transfer from the engine to the organic propellant; rate of condensation of propellant; volume of organic propellant; flow rate of organic propellant; or propellant pressure within the system.

13. The system as in claim 1, further comprising a power hub for receiving secondary power and supplying electric power to system components.

14. The system as in claim 1, wherein the condenser is located proximal to a jacket fluid radiator and wherein the control system operates an electric fan for blowing air across the radiator and condenser simultaneously.

15. The system as in claim 1, further comprising an air cooled radiator for cooling engine jacket fluid, whereby engine jacket fluid within the radiator is cooled by blowing ambient air across the radiator with a fan, and wherein the control module modulates the speed of the fan based on the temperature of the jacket water, such that the jacket water is cooled prior to its return to the engine.

16. The system as in claim 1 wherein the natural gas compression module further comprises a boost compressor powered with secondary power generated by the expander.

17. The system as in claim 16, wherein the secondary power is provided as mechanical shaft horsepower or electric power.

18. The system as in claim 1, wherein the natural gas compression module further comprises a cooling module to remove heat from the natural gas after at least one stage of compression.

19. The system as in claim 18, wherein the cooling module transfers thermal energy from the natural gas to the organic propellant.

20. The system as in claim 18, wherein the natural gas cooling module comprises a fan for blowing air across natural gas conduits, and wherein the fan is powered with secondary power generated by the expander.

21. The system as in claim 20, wherein the series of natural gas conduits are located proximal to the organic propellant condenser, and wherein the control system operates an electric fan for blowing air across the conduits and the condenser simultaneously.

22. The system as in claim 20, wherein the series of natural gas conduits are located proximal to an engine radiator, and wherein the control system operates an electric fan for blowing air across the radiator and conduits simultaneously.

23. The system as in claim 20, wherein the series of conduits are located proximal to the organic propellant condenser and an engine jacket fluid radiator, such that the fan simultaneously blows air across the gas cooling conduits, the condenser, and the radiator.

24. The system as in claim 1, wherein the expander is a screw expander.

25. The system as in claim 24, wherein rotational speed of the screw expander is adjusted using a throttle valve, which throttle valve is monitored and regulated by a speed control module.

26. The system as in claim 1, further comprising a recuperator for recovering thermal energy from organic propellant exiting the expander.

27. The system as in claim 1, further comprising a tertiary power source for providing supplementary power when primary and secondary power outputs are insufficient to meet local Power demands.

28. The system as in claim 1, wherein the control module regulates operation of the Rankine cycle through communication with at least one variable frequency drive or relay.

29. A system for providing power at a remote site comprising: a reciprocating engine operable to provide a primary power output and one or more sources of thermal energy; a natural gas compression module powered by said reciprocating engine; an organic Rankine cycle for collecting thermal energy from the reciprocating engine and converting said thermal energy to secondary power output; a control module for regulating operating conditions of the engine and organic Rankine cycle to maximize secondary power output; a tertiary power source; and a power hub for receiving a combination of primary, secondary, and tertiary power and for supplying power to the site on demand.

30. The system as in claim 29, wherein the tertiary power source is grid power.

31. The system as in claim 29, wherein the tertiary power source is a generator.

32. The system as in claim 1, wherein the secondary power source produces electric power for use in powering the parasitic load.

33. The system as in claim 1, wherein the sensor is located at the expander or condenser.

34. The system as in claim 1, further comprising a tertiary power source for providing supplementary power to the power hub.

* * * * *